United States Patent [19]

Goodwin

[11] Patent Number: 5,050,494

[45] Date of Patent: Sep. 24, 1991

[54] FINE ADJUSTMENT SYSTEM OF FINISHING HEAD IN A PRINTING, DUPLICATING AND LIKE MACHINE

[75] Inventor: Eber L. Goodwin, Arlington Heights, Ill.

[73] Assignee: Am International, Inc., Chicago, Ill.

[21] Appl. No.: 420,925

[22] Filed: Oct. 13, 1989

[51] Int. Cl.[5] ..... B41F 13/56

[52] U.S. Cl. ..... 101/76; 101/226

[58] Field of Search ..... 101/72, 76, 224, 226, 101/227; 83/663, 665

[56] References Cited

U.S. PATENT DOCUMENTS

| | | | |
|---|---|---|---|
| 3,224,367 | 12/1965 | Henkel | 101/224 |
| 4,177,730 | 12/1979 | Schriber et al. | 101/226 |
| 4,426,929 | 1/1984 | Fujisawa et al. | 101/226 |
| 4,583,459 | 4/1986 | Abendroth et al. | 101/227 |
| 4,598,638 | 7/1986 | Fujii et al. | 101/226 |

*Primary Examiner*—Edgar S. Burr
*Assistant Examiner*—Joseph R. Keating
*Attorney, Agent, or Firm*—Wood, Phillips, Mason, Recktenwald & VanSanten

[57] ABSTRACT

A system for adjusting a finishing head relative to an impression cylinder in a printing, duplicating and like machine wherein copy sheets are fed through a printing couple and then to a finishing couple which includes the impression cylinder. The finishing head includes a finishing wheel for penetrating a copy sheet on the impression cylinder, and the head is mounted on a bar which is rotatably mounted between side frame plates of the machine. A preliminary adjusting mechanism is provided between the head and the bar for preliminarily adjusting the position of the finishing wheel relative to the bar. The bar is removably mounted between the side frame plates so that the preliminary adjustment can be made away from the machine. A very fine adjusting system is provided on the machine, operatively associated with the bar and including a dial on the outside of one of the side frame plates to provide fine adjustment of the finishing wheel while the machine is operating. A lateral adjusting mechanism is mounted on one of the side frame plates and is operatively associated with the bar for adjustably moving the bar longitudinally and thereby adjusting the finishing wheel axially of the impression cylinder.

18 Claims, 5 Drawing Sheets

FINE ADJUSTMENT SYSTEM OF FINISHING HEAD IN A PRINTING, DUPLICATING AND LIKE MACHINE

FIELD OF THE INVENTION

This invention generally relates to printing or duplicating machines and, more particularly, to a system for providing very fine adjustment of a finishing head which performs such functions as perforating, scoring and embossing the copy sheets.

BACKGROUND OF THE INVENTION

Printing machines normally include a printing couple which comprises a number of cylinders and/or rollers such as impression cylinders, master cylinders and blanket cylinders which form the printing couples of the machine. An ink system also includes various form rollers, ductor rollers, transfer rollers and the like for feeding ink to the various cylinders of the printing couple. In such printing machines as rotary offset lithographic duplicating machines, a moisture system also is provided and includes rollers similar to the ink system for feeding moisture to the printing couple. After printing, the sheets are fed to some form of sheet receiving means at an exit end of the machine for stacking copy sheets issuing from the machine.

Some machines of the character described also include a finishing couple which, itself, includes an impression cylinder along with other cylinders or drums for performing various operations on the copy sheets after they have issued from the printing couple and before the sheets are fed to the receiving means at the exit end of the machine. Specifically, the printing couple may perforate the copy sheets along perforation lines, either "horizontally" or "vertically", or selectively emboss the copy sheets, or score (slit) the copy sheets, or sequentially number the copy sheets. All such operations normally are performed on the sheets after they have issued from the printing couple.

A common example of such operations is a normal bank checkbook wherein each check is sequentially numbered and also includes a perforation line for tearing the checks out of the book. The checks also are imprinted with the bank's number or code as well as the individual's bank account number. These operations are termed "finishing" operations, because the checks themselves are printed with standard formats for all checks and, often, include a standard design selected from a given group of designs, with the format and the particular design being on a permanent master which prints the checks in the printing couple before reaching the finishing couple.

A major problem with finishing systems of the character described above, is the inability to efficiently adjust some of the finishing heads which perform the finishing operations. Most often, adjustments must be made within the machine and must be made while the machine is shut down. Even if a fine adjusting means is provided, an operator, often pressed for time, will ignore poor quality finishing operations because of the inefficiency of most systems.

An example of a poor quality finishing operation is where the copy sheets must be perforated or scored along a horizontal or vertical line. This is performed by a perforating or scoring wheel which penetrates the copy sheets on the impression cylinder. Practically everyone has experienced poor quality perforations where it is difficult to tear an individual sheet from a "book" of sheets along an inadequate perforation line without tearing into the body of the sheet itself. Bank checkbooks, above, is one example, as is an ordinary tablet of writing paper. Just the opposite, perforations may be excessive and result in the sheets tearing along a perforation line too easily when an individual wishes to write on the check or tablet sheet while it still is in book form. The significance of fine adjustment of such finishing operations can be understood when considering the very small thickness of the sheets themselves which actually define the range of adjustment.

This invention is directed to solving these problems by providing a new and improved, very fine adjustment system of a finishing head in a printing, duplicating and like machine, including an ability to make adjustments from outside the machine while the machine is operating.

SUMMARY OF THE INVENTION

An object, therefore, of the invention is to provide an adjusting system for a finishing head in a printing, duplicating and like machine.

The printing or duplicating machine is of a type wherein copy sheets are fed through a printing couple and then to a finishing couple which includes an impression cylinder rotatably mounted on appropriate shaft means extending between spaced side frame plates of the machine. The adjusting system includes means for adjusting the finishing head in a direction transverse to the impression cylinder and its shaft means to bury the depth at which a finishing wheel on the head penetrates a copy sheet on the impression cylinder.

As disclosed herein, a bar is rotatably mounted between the side frame plates of the machine. The finishing head is mounted on the bar so that its finishing wheel is in position to engage a copy sheet on the impression cylinder. This positioning is accomplished by a preliminary adjusting means between the finishing head and the bar.

Fine adjusting of the finishing head and finishing wheel is accomplished by a system which includes a lever fixed to the bar and extending transversely outwardly therefrom. An adjusting shaft is engageable with the lever at location spaced from the bar. The adjusting shaft is threadedly mounted on the machine to move the lever and rotate the bar in response to rotation of the shaft whereby a very fine adjustment of the finishing wheel relative to the impression cylinder is achieved through the pitch of the shaft threads and a movement reduction of the lever means.

Preferably, the adjusting shaft is mounted outside of one of the side frame plates of the machine and includes a dial for rotating the shaft while the machine is operating.

Another feature of the invention is the provision of lateral adjusting means mounted on one of the side frame plates and operatively associated with the bar for adjustably moving the bar longitudinally and thereby adjusting the finishing wheel axially of the impression cylinder.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
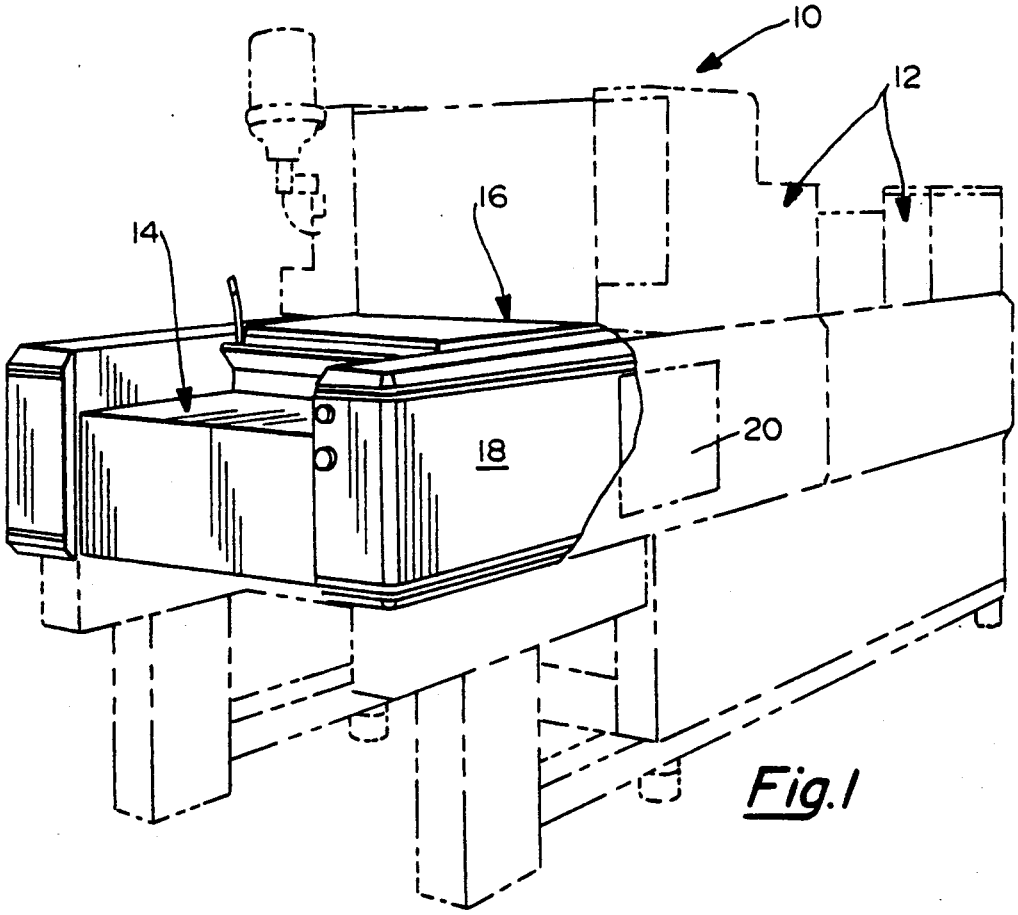
FIG. 1 is a somewhat schematic illustration of a duplicating machine, highlighting the exit end of the machine in front of which the finishing couple of the machine is located.

Referring to the drawings in greater detail, and first to FIG. 1, the invention is disclosed in conjunction with a printing, copying or duplicating machine, such as a rotary offset lithographic duplicating machine, generally designated 10. The machine may include one or more printing couples, located in the areas generally designated 12 and from which copy sheets are delivered by appropriate conveyor means to some form of sheet receiving means at an exit end of the machine, shown in full lines generally at 14. As stated above, some such machines include a finishing couple for performing various finishing operations on the copy sheets after they issue from the printing couples. The finishing couple is located in the general area 16 of the machine, between printing couples 12 and exiting end 14. The machine has an outer aesthetic covering 18 which not only provides a pleasing appearance for the machine, but covers many of the operative components of the machine, such as the gears, linkages, etc. for safety purposes. FIG. 1 schematically shows a door 20 for gaining access to the fine adjusting means of the invention, as described hereinafter.

Figure 2:
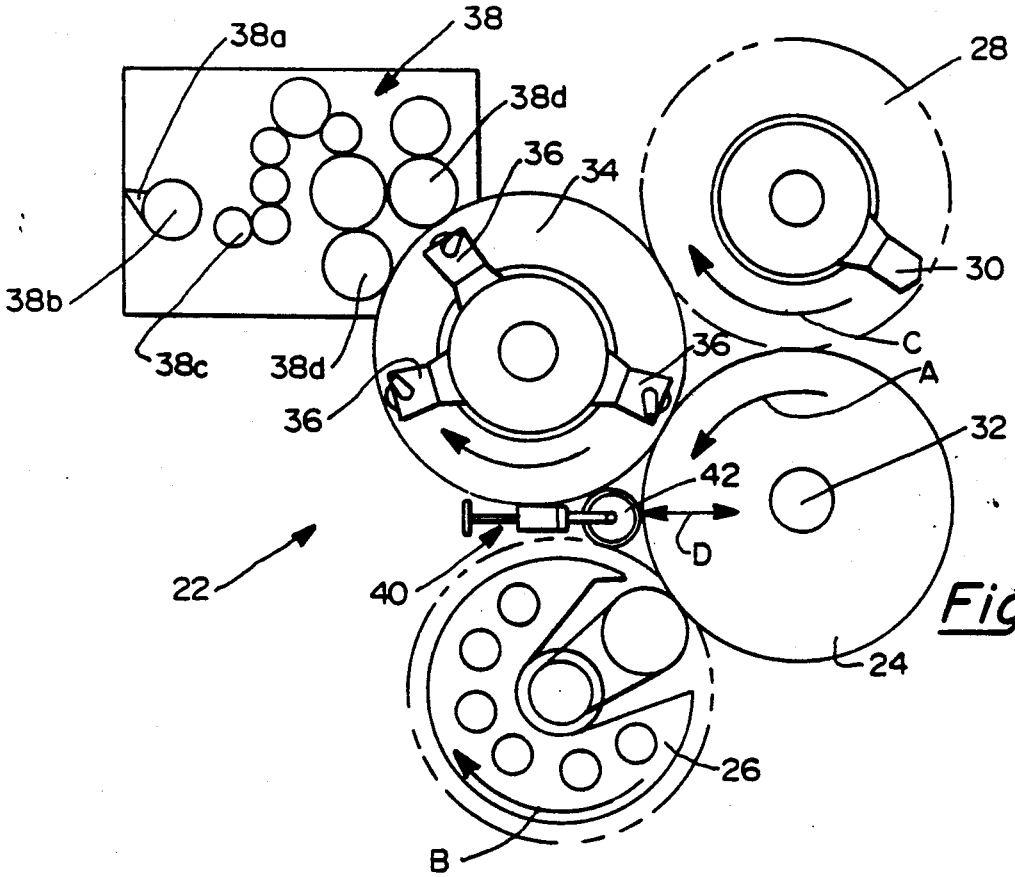
FIG. 2 is a schematic illustration as would be taken vertically through the finishing couple of the machine.

FIG. 2 shows a finishing couple, generally designated 22, for performing various finishing operations on the copy sheets as they issue from the printing couple or couples. The sheets will issue onto an impression cylinder 24 which carries the sheets in the direction of arrow "A" and to a transfer drum 26 which then transfers the sheets in the direction of arrow "B" to a conveyor means, such as a chain delivery device, which delivers the sheets to a stacking tray (not shown) at exiting end 14 (FIG. 1) of the machine.

One form of operation which may be performed by finishing couple 22 is to "horizontally" perforate or score the copy sheets. This is done by a drum 28 which rotates in the direction of arrow "C" to bring an elongated, horizontal perforating or scoring bar 30 into engagement with the sheets as they move seriatim with and on the periphery of impression cylinder 24. The term "horizontal" is meant to mean in the axial direction of impression cylinder 24 which is mounted on a horizontal shaft 32. Another operation that can be performed by finishing couple 22 is to sequentially number the copy sheets with one or more series of numerical indicia. This is performed by a numbering cylinder 34 having a plurality of indexable numbering heads 36 spaced angularly thereabout for imprinting numbers on the copy sheets moving about impression cylinder 24. An example of a numbering system and the exiting end of the machine is shown in my co-pending U.S. patent application Ser. No. 420,944 which is assigned to the assignee of this invention, which is being filed contemporaneously herewith and which is incorporated herein by reference. Numbering heads 36 receive ink from an ink unit, generally designated 38, which is shown schematically to include an ink fountain 38*a*, a fountain roller 38*b*, a ductor roller 38*c* and various other rollers for feeding the ink to a pair of form rollers 38*d* which apply the ink to the numbering heads 36.

Figure 3:
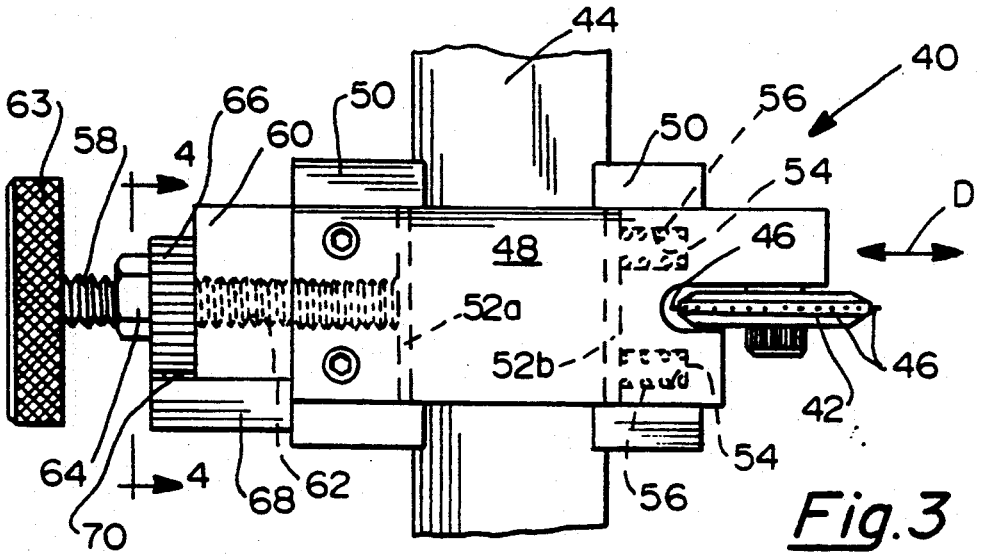
FIG. 3 is a top plan view of the finishing head of the finishing couple.

FIG. 2 also shows a vertical perforating or scoring head, generally designated 40, which includes a perforating or scoring wheel 42 for perforating or scoring copy sheets moving with the periphery of impression cylinder 24. As with the term "horizontal", the term "vertical" means that the perforation or score lines are cut in an actual vertical direction relative to the machine and the horizontal axis 32 of impression cylinder 24. FIG. 3 shows that vertical perforating or scoring head 40 is mounted on a bar 44 which extends transversely across the machine generally parallel to impression cylinder 24 and generally between numbering cylinder 34 and transfer drum 26. Wheel 42 is shown in FIG. 3 to include perforating cutters 46 which actually cut closely spaced holes into the copy sheets, as is known. Therefore, wheel 42 and head 40 may be described hereinafter as a "perforating" wheel or head, with the understanding that such a wheel on head 40 could be a scoring wheel with a continuous peripheral edge to cut or slit the paper or a "dull" wheel to emboss the paper and, therefore, the wheel and head actually can perform various finishing functions besides perforating the copy sheets.

Finishing head 40 is shown in FIG. 3 to include a top plate 48 and a pair of side plates 50 for embracing bar 44 somewhat loosely. Interior bearing plates 52*a* and 52*b* are disposed between side plates 50 and bar 44. The right-hand (as viewed in the drawing) side plate 50 has a pair of sockets 54 for receiving a pair of coil springs 56 which take up the slack or looseness of the aforesaid fit. An adjusting screw 58 is threaded through an extension block 60 fixed to the left-hand plate 50, as at 62 A knurled knob 63 is fixed to the outer distal end of adjusting screw 58 for manually rotating the screw. The inner distal end of the screw abuts against bearing plate 52*a*. A lock nut 65 also is threaded onto screw 58. Still further, a serrated ratchet wheel 66 is fixed to the shaft and sandwiched between lock nut 65 and extension block 60.

With the construction of finishing head 40 described immediately above, rotation of knurled knob 63 and screw 58 is effective to adjust finishing wheel 42 in the direction of double-headed arrow "D". Specifically, lock nut 64 is loosened to permit rotation of screw 58. Rotation of the screw causes plates 48 and 50 to move transversely, i.e., in the direction of arrow "D" against or with the biasing of springs 56 against bearing plate **52*b* which engages bar 40. In other words, the entire assembly moves transverse to bar 40 except, of course, for bearing plates 52*a*, 52*b*. The affect of the adjustment is to adjust the distance between finishing wheel 42 (perforating means 46 if it is a perforating wheel) and the surface of impression cylinder 24 as described in relation to FIG. 2. Double-headed arrow "D" is shown in FIG. 2 in order to facilitate correlation of the figures Once proper adjustment is made, lock nut 64 is tightened against serrated wheel 64 to lock screw 58 in its position of rotatable adjustment. During operation, the head still can move relative to bar 44 because of the spring loading afforded by springs 56 in order to compensate for any irregularity in impression cylinder 24. In other words, the extreme position of head 40 and wheel 42 in the direction of the impression cylinder is fixed by the abutment of adjusting screw 58 with bearing plate 52*a*. However, the finishing head and wheel can yield against springs 56** should there be some form of irregularity in the impression cylinder.

Figure 4:
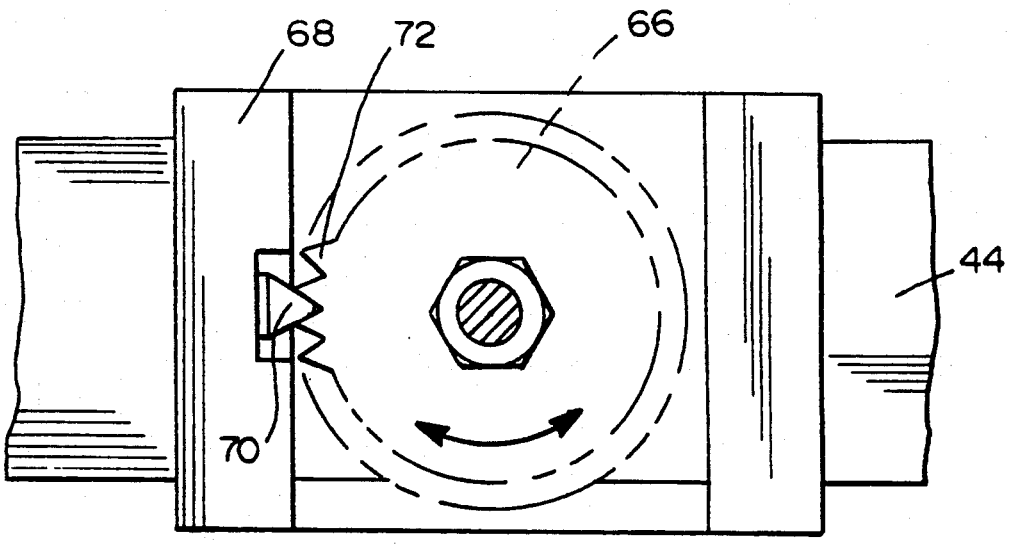
FIG. 4 is a section, on an enlarged scale, taken generally along line 4—4 of FIG. 3.

Referring to FIG. 4 in conjunction with FIG. 3, a side block 68 is fixed to extension block 60 and includes a spring-loaded detent 70 which is biased into engagement with the periphery of serrated wheel 66, the serrations on the wheel being shown as teeth 72 in the enlarged depiction of FIG. 4. Therefore, as threaded screw 58 is rotated by knob 64, a "clicking" type indexing of the adjustable rotation is provided.

After finishing head 40 and finishing wheel 42 are preliminarily adjusted on bar 44, a very fine adjusting system is provided for use during operation of the machine. This enables an operator to proof sheets at the exiting end of the machine and to very easily adjust the perforating, scoring or embossing action on the copy sheets by the fine adjusting system shown in FIG. 5.

Figure 5:
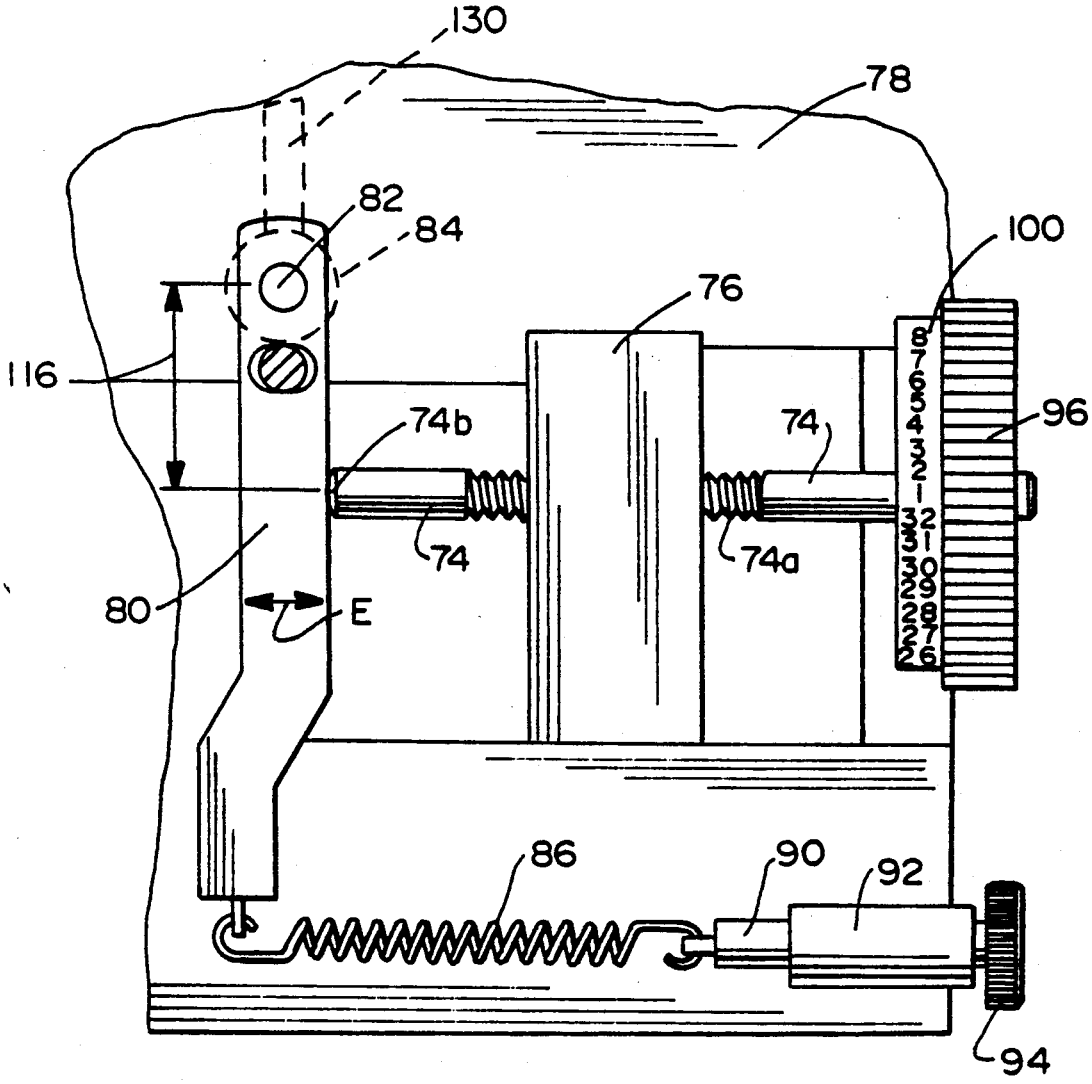
FIG. 5 is an elevational view of a portion of the fine adjusting means for the printing head of FIG. 3.

More particularly, an adjusting shaft 74 has a threaded portion **74*a* threaded through a fixed block 76 on a side frame plate 78 of the machine. It should be understood that most such machines have substantial side frame plates extending along each side of the machine, enclosed by cover 18 (FIG. 1) and to which many of the operative components of the machine are mounted or journaled. One of the side plates 78 is shown in FIG. 5. A distal end 74*b* of adjusting shaft 74 abuts against a lever 80 fixed by a stub shaft 82 which extends outwardly through side frame plate 78 from a larger diameter stub shaft 84 located inside of the side frame plate. The stub shafts define the pivot point for lever 80. The lever is held into engagement with distal end 74*b* of adjusting shaft 74 by a spring 86, the tension in the spring being adjustable by a rod 90 which is threaded through a block 92 fixed to side frame plate 78. A knurled knob 94 is provided on the outer end of threaded rod 90** for adjusting the tension in the spring.

Figure 6:
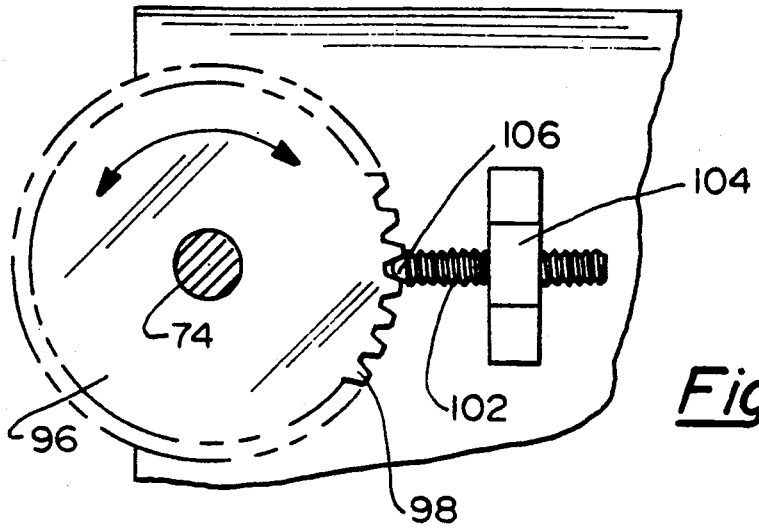
FIG. 6 is a view of the detent means for the rotatable dial shown in FIG. 5.

A calibrated knob or wheel 96 is fixed to the outer end of adjusting shaft 74, the wheel being serrated to define a given number of teeth 98 as shown in FIG. 6. To be precise, as shown by numbered indicia 100 in FIG. 5, there are precisely thirty-two teeth 98 about the periphery of wheel 96. Although not visible in FIG. 5, a detent rod 102 is threaded into a frame block 104, with a spring loaded ball 106 on an end of the rod for engagement between teeth 98. This provides a ratcheting type "clicking" feel for an operator in rotating wheel 96 so that the number of teeth can be counted for purposes described hereinafter.

Figure 8:
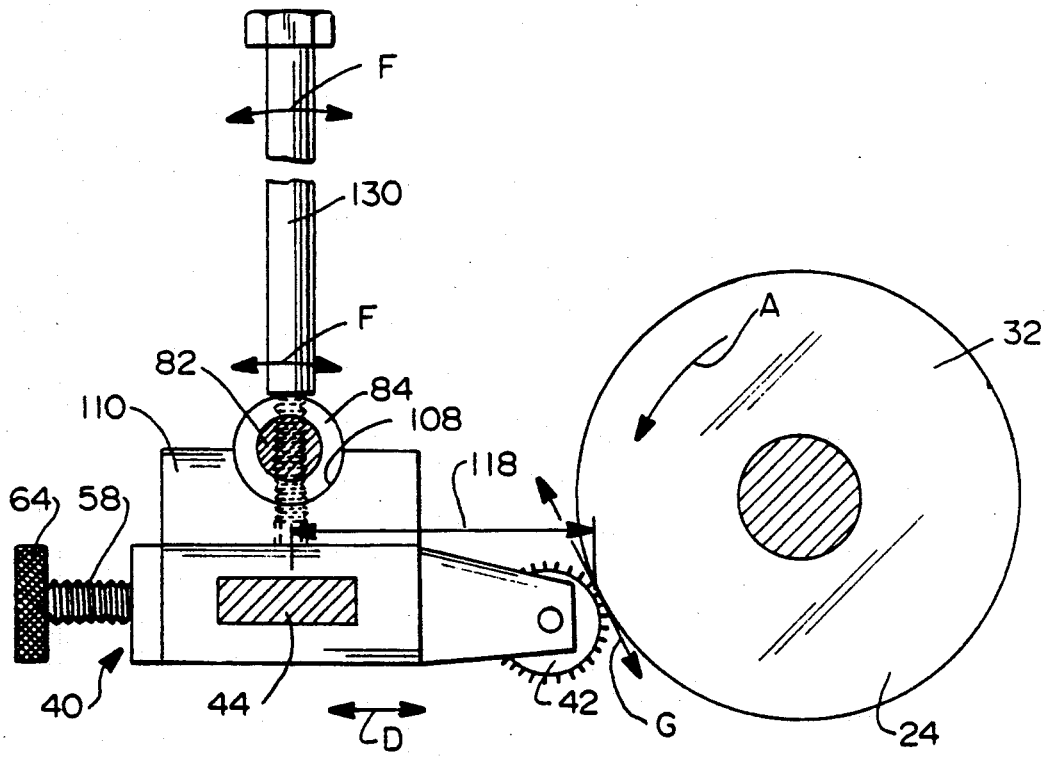
FIG. 8 is a vertical section through the impression cylinder, the head-mounting bar and the adjusting rod for the finishing head.
Figure 9:
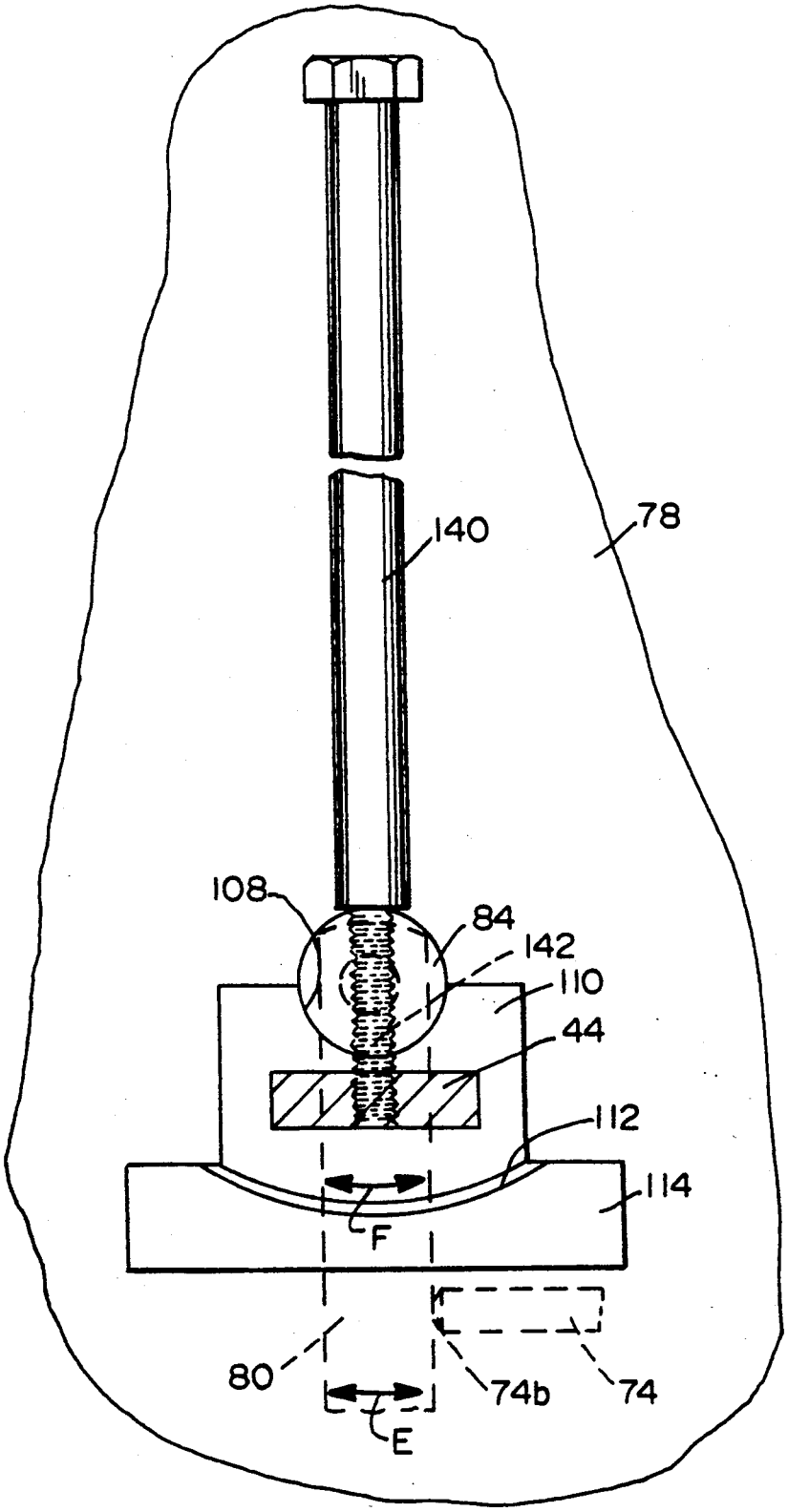
FIG. 9 is a vertical section through the head mounting bar and adjusting rod in conjunction with the bracket means for removably mounting the bar between side frame plates of the machine.

Referring to FIG. 8, in conjunction with FIG. 5, finishing head 40 and finishing wheel 42 are shown somewhat schematically mounted on bar 44 as described in relation to FIG. 3. The position of the head relative to impression cylinder 24 also can be seen in FIG. 8 and correlated with FIG. 2. Enlarged stub shaft 84 (described in relation to FIG. 5) is shown seated in a semi-cylindrical saddle 108 in a bracket block 110. As seen in FIG. 9, in conjunction with FIG. 8, bracket block 110, in turn, seats in an arcuate saddle 112 in a bracket 114 fixed to the inside of side frame plate 78 on the side of the frame plate opposite that shown in FIG. 5. It also can be seen in FIGS. 8 and 9 that bar 44 which mounts finishing head 40 extends through bracket block 110. It should be understood that an identical bracket assembly, including bracket block 110 and bracket 114, are provided on the opposite end of bar 44 on the inside of the opposite side frame plate of the machine.

With the above description of FIGS. 5, 8 and 9, it can be understood that rotation of adjusting shaft 74 by an operator grasping toothed wheel 96 will cause lever 80 to pivot in the direction of double-headed arrow "E" with stub shaft 82 which projects through side frame plate 78. This also can be seen in FIG. 9. As the lever pivots, the enlarged stub shaft 84 (FIGS. 8 and 9) which is fixed in saddle 108 of bracket block 110 will cause the bracket block and bar 44 to rotate in the direction of double-headed arrow "F". It should be noted in FIG. 9 that saddle 112 in bracket 114 is spaced below the bottom of bracket block 110 and, therefore, does not interfere with rotation of the block and bar 44. The purpose of this spacing will be described hereinafter. Rotation of bracket block 112 and bar 44 in the direction of double-headed arrow "F" causes finishing wheel 42 to move in the direction of double-headed arrow "G" relative to impression cylinder 24 as shown in FIG. 8. In essence, the periphery of the finishing wheel is located in a position that it moves generally tangentially of the surface of impression cylinder 24 but very slightly intersects the tangent. This positioning is established by the preliminary adjustment described in relation to FIG. 3 as indicated by double-headed arrow "D" in that figure and also in FIG. 8. In most machines heretofore available, that is the only adjustment provided. However, the fine adjustment of the invention provided by the system described in relation to FIGS. 5, 8 and 9 affords an extremely fine, final adjustment and can be performed during operation of the machine because dial 96 (FIG. 5) is located outside the machine, i.e., on the outside of side frame plate 58. Access can be afforded to the adjusting dial through door 20 (FIG. 1) of the machine.

For instance, using some approximations, exemplary dimensions and given parameters, it can be shown that one "click" of dial 96, which is equivalent to one toothed movement of detent ball 106 (FIG. 6), can effect as small an adjustment as 0.0001 inch (or 0.0025 mm) of finishing wheel 42 toward and away from the surface of impression cylinder, i.e., penetration of a copy sheet. This can be calculated by providing threaded portion **74*a* of adjusting shaft 74 with a pitch whereby there are twenty threads per inch. In other words, one revolution of dial 96 to effect one revolution of adjusting shaft 74 is equal to 0.05 inch linear movement of the shaft. Since there are thirty-two teeth on dial 96, and dividing 0.05 inch by the thirty-two teeth equals 0.0015 inch linear movement of the adjusting shaft per one "toothed" rotation of dial 96. Assuming that the distance between the point at which adjusting shaft 74 engages lever 80 is three inches below the pivot point for the lever, as indicated at 116 in FIG. 5**, the motion reduction of the lever to the pivot point converts the 0.0015 inch linear movement of the shaft to 0.0005 inch, keeping in mind that these calculations are approximations and for illustration purposes only.

Taking the motion reduction a step further, and referring to FIG. 8, assuming that the distance of the pivot point of lever 80 to a tangent point of impression cylinder 24 is 2.5 inch, as indicated at 118, dividing the 0.0005 figure by the 2.5 inch distance results in a further motion reduction to 0.0002 inch (or 0.005 mm) per "click" on dial 96. Since the movement of finishing wheel 42 is along a tangent of the surface of impression cylinder 24, the motion reduction is reduced still further by approximately one-half, because we are adjusting the wheel perpendicular to the impression cylinder to adjust the depth the wheel penetrates the copy sheet. Consequently, this fifty percent reduction results in a transverse movement relative to the impression cylinder of 0.0001 inch (or 0.0025 mm), for a single incremental rotation of dial 96 as defined by its thirty-two teeth 98. As stated, these dimensions and/or parameters may be approximations, but they emphatically show the extremely fine adjustment that is achieved by the drive train between the dial and the finishing wheel as effected by the threaded adjusting shaft 74 and the lever arrangement of the drive train.

Figure 7:
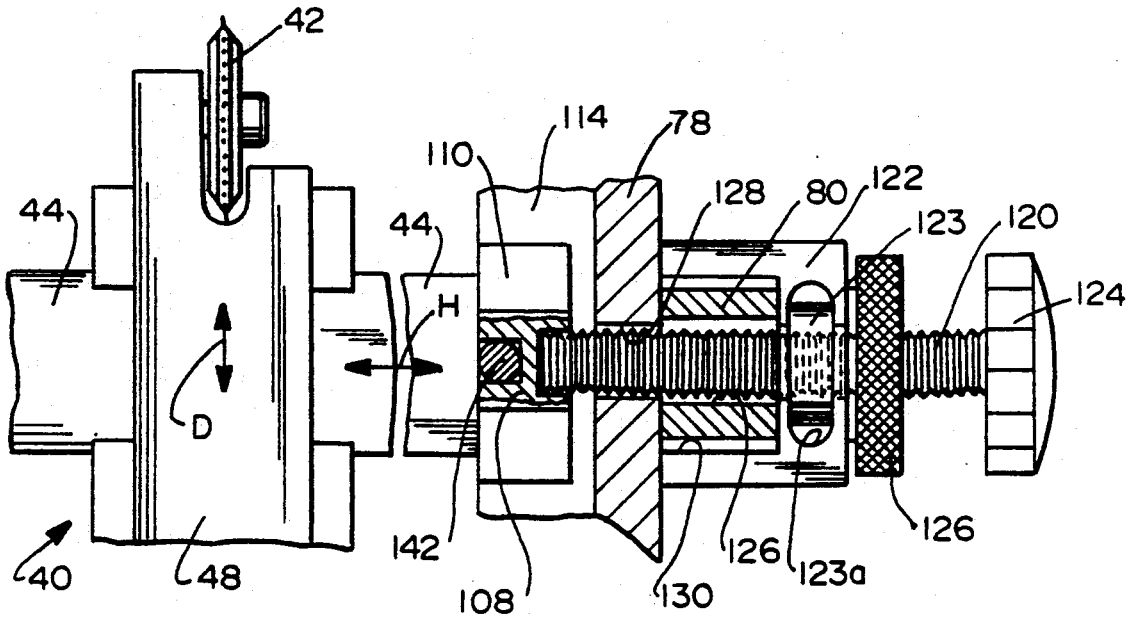
FIG. 7 is a fragmented top plan view of the adjusting means for laterally adjusting the bar which supports the finishing couple.

FIG. 7 shows another feature of the invention wherein finishing head 40 and finishing wheel 42 is adjustable longitudinally along bar 44, i.e., generally parallel to impression cylinder 24, as indicated by double-headed arrow "H" in FIG. 7. Before proceeding, it should be understood that enlarged stub shaft 84 has been removed from the view so that the depiction is looking down into saddle 108 in bracket block 108. Specifically, a threaded adjusting shaft 120 extends through a block 122 fixed to side frame plate 78. The shaft is threaded through a nonrotatable nut 123 captured in an opening **123*a* in block 122. A knob 124 is provided to facilitate manual rotation of shaft 122, and a knurled locking wheel 126 is threaded onto the shaft for locking against block 122 to hold the shaft in any position of adjustment. Threaded adjusting shaft 122 extends freely through an enlarged aperture 126 in lever 80 (see FIG. 5) and through a bore 128 in side frame plate 78. Enlarged aperture 126 allows movement of the lever without interference by the shaft. The lever also extends through an enlarged opening 130 in block 122 and can move freely therewithin. The inner distal end 132 of shaft 120 is captured within a recess 134 in bracket block 110** in such a manner that axial movement of the shaft moves the bracket block in the direction of double-headed arrow "H".

Lastly, referring to FIGS. 8 and 9, it can be seen that a long bolt 140 having a threaded 142 is threaded entirely through enlarged stub shaft 84, bracket block 110 and into bar 44, to hold all of those components together for rotation in the direction of double-headed arrow "F" in response to movement of lever 80.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a printing, duplicating and like machine wherein copy sheets are fed through a printing couple and then to a finishing couple which includes an impression cylinder rotatably mounted on appropriate shaft means extending between spaced side frame plates of the machine, a system for adjusting a finishing head in a direction transverse to the impression cylinder and its shaft means to vary the depth at which a finishing wheel on the head penetrates a copy sheet on the impression cylinder, comprising:

a bar rotatably mounted between the side frame plates;

mounting means for mounting the finishing head directly on the bar such that the finishing wheel is in position to engage a copy sheet on the impression cylinder;

lever means, separate from said mounting means, fixed to the bar and extending transversely outwardly therefrom; and an adjusting shaft engageable with the lever means at a location spaced from the bar, the shaft being threadedly mounted on the machine to move the lever means and rotate the bar in response to rotation of the shaft whereby a very fine adjustment of the finishing wheel relative to the impression cylinder is achieved through the pitch of the shaft threads and a movement reduction of the lever means.

2. The system of claim 1 wherein said mounting means projects transversely outwardly from the rotatably mounted bar to space the finishing wheel from the bar and provide a further movement reduction therebetween.

3. The system of claim 2 wherein said mounting means has a length such that the finishing wheel moves generally tangentially of the surface of the finishing wheel.

4. The system of claim 1, including a dial on the adjusting shaft to facilitate manually rotating the same.

5. The system of claim 4 wherein said dial is located outside one of the side frame plates whereby adjustments can be made while the machine is operating.

6. The system of claim 1, including spring means for biasing the lever means into engagement with the adjusting shaft.

7. The system of claim 1 wherein said mounting means include means for adjusting the position of the finishing wheel transversely of the bar and the impression cylinder.

8. The system of claim 1, including bracket means for readily removably mounting said bar on the side frame plates.

9. The system of claim 8 wherein said bracket means include means defining pivots for said rotatable mounting of the bar between the side frame plates.

10. The system of claim 1, including lateral adjusting means between said bar and at least one of the side frame plates for adjustably moving the bar longitudinally and thereby adjusting the finishing wheel axially of the impression cylinder.

11. In a printing, duplicating and like machine wherein copy sheets are fed through a printing couple and then to a finishing couple which includes an impression cylinder rotatably mounted on appropriate shaft means extending between spaced side frame plates of the machine, a system for adjusting a finishing head in a direction transverse to the impression cylinder and its shaft means to vary the depth at which a finishing wheel on the head penetrates a copy sheet on the impression cylinder, comprising:

a bar rotatably mounted between the side frame plates;

mounting means for mounting the finishing head on the bar such that the finishing wheel is in position to engage a copy sheet on the impression cylinder;

lever means fixed to the bar and extending transversely outwardly therefrom; and an adjusting shaft engageable with the lever means at a location spaced from the bar, the shaft being threadedly mounted on the machine to move the lever means and rotate the bar in response to rotation of the shaft whereby a very fine adjustment of the finishing wheel relative to the impression cylinder is achieved through the pitch of the shaft threads and a movement reduction of the lever means, said system including a dial on the adjusting shaft to facilitate manually rotating the same, said system further including detent-and-tooth means operatively associated with one of the dial and the adjusting shaft to provide for a clicking feel during adjustment.

12. In a printing, duplicating and like machine wherein copy sheets are fed through a printing couple and then to a finishing couple which includes an impression cylinder rotatably mounted on appropriate shaft means extending between spaced side frame plates of the machine, a system for adjusting a finishing head in a direction transverse to the impression cylinder and its shaft means to vary the depth at which a finishing wheel on the head penetrates a copy sheet on the impression cylinder, comprising:

a bar rotatably mounted between the side frame plates;

mounting means for mounting the finishing head directly on the bar such that the finishing wheel is in position to engage a copy sheet on the impression cylinder, including means for preliminarily adjusting the position of the finishing wheel transversely of the bar and the impression cylinder;

lever means, separate from said mounting means, fixed to the bar and extending transversely outwardly therefrom;

an adjusting shaft engageable with the lever means at a location spaced from the bar, the shaft being threadedly mounted on the machine to move the lever means and rotate the bar in response to rotation of the shaft whereby a very fine adjustment of the finishing wheel relative to the impression cylinder is achieved through the pitch of the shaft threads and a movement reduction of the lever means; and lateral adjustment means between said bar and at least one of the side frame plates for adjustably moving the bar longitudinally and thereby adjusting the finishing wheel axially of the impression cylinder.

13. In a printing, duplicating and like machine wherein copy sheets are fed through a printing couple and then to a finishing couple which includes an impression cylinder rotatably mounted on appropriate shaft means extending between spaced side frame plates of the machine, a system for adjusting a finishing head in a direction transverse to the impression cylinder and its shaft means to vary the depth at which a finishing wheel on the head penetrates a copy sheet on the impression cylinder, comprising:

a bar rotatably mounted between the side frame plates;

mounting means for mounting the finishing head directly on the bar such that the finishing wheel is in position to engage a copy sheet on the impression cylinder, including means for preliminarily adjusting the position of the finishing wheel transversely of the bar and the impression cylinder;

lever means, separate from said mounting means, fixed to the bar and extending transversely outwardly therefrom;

an adjusting shaft engageable with the lever means at a location spaced from the bar, the shaft being threadedly mounted on the machine to move the lever means and rotate the bar in response to rotation of the shaft whereby a very fine adjustment of the finishing wheel relative to the impression cylinder is achieved through the pitch of the shaft threads and a movement reduction of the lever means; and bracket means for readily removably mounting the bar ont the side frame plates.

14. The system of claim 13 wherein said bracket means include means defining pivots for said rotatable mounting of the bar between the side frame plates.

15. In a printing, duplicating and like machine wherein copy sheets are fed through a printing couple and then to a finishing couple which includes an impression cylinder rotatably mounted on appropriate shaft means extending between spaced side frame plates of the machine, a system for adjusting a finishing head in a direction transverse to the impression cylinder and its shaft means to vary the depth at which a finishing wheel on the head penetrates a copy sheet on the impression cylinder, comprising:

a bar rotatably mounted between the side frame plates;

bracket means for readily removably mounting the bar ont the side frame plates;

mounting means for mounting the finishing head directly on the bar such that the finishing wheel is in position to engage a copy sheet on the impression cylinder;

lever means, separate from said mounting means, fixed to the bar and extending transversely outwardly therefrom;

an adjusting shaft engageable with the lever means at a location spaced from the bar, the shaft being threadedly mounted on the machine to move the lever means and rotate the bar in response to rotation of the shaft whereby a very fine adjustment of the finishing wheel relative to the impression cylinder is achieved through the pitch of the shaft threads and a movement reduction of the lever means; and lateral adjusting means between said bar and at least one of the side frame plates for adjustably moving the bar longitudinally and thereby adjusting the finishing wheel axially of the impression cylinder.

16. In a printing, duplicating and like machine wherein copy sheets are fed through a printing couple and then to a finishing couple which includes an impression cylinder rotatably mounted on appropriate shaft means extending between spaced side frame plates of the machine, a system for adjusting a finishing head in a direction transverse to the impression cylinder and its shaft means to vary the depth at which a finishing wheel on the head penetrates a copy sheet on the impression cylinder, comprising:

a bar rotatably mounted between the side frame plates;

mounting means for mounting the finishing head on the bar such that the finishing wheel is in position to engage a copy sheet on the impression cylinder, means for preliminarily adjusting the position of the finishing wheel transversely of the bar and the impression cylinder; and fine adjusting means including a manually manipulatable dial and a drive train between the dial and the finishing head to adjust the position of the finishing wheel relative to the impression cylinder, the dial being located outside one of the side frame plates whereby fine adjustment can be made while the machine is operating.

17. In a printing, duplicating and like machine wherein copy sheets are fed through a printing couple and then to a finishing couple which includes an impression cylinder rotatably mounted on appropriate shaft means extending between spaced side frame plates of the machine, a system for adjusting a finishing head in a direction transverse to the impression cylinder and its shaft means to vary the depth at which a finishing wheel on the head penetrates a copy sheet on the impression cylinder, comprising:

a bar mounted between the side frame plates;

mounting means for mounting the finishing head on the bar such that the finishing wheel is in position to engage a copy sheet on the impression cylinder, including means for adjusting the position of the finishing wheel relative to the bar and the impression cylinder; and bracket means for readily removably mounting the bar on the side frame plates whereby adjusting the position of the finishing wheel can be performed away from the machine.

18. In a printing, duplicating and like machine wherein copy sheets are fed through a printing couple and then to a finishing couple which includes an impression cylinder rotatably mounted on appropriate shaft means extending between spaced side frame plates of the machine, a system for adjusting a finishing head in a direction transverse to the impression cylinder, comprising:

a bar mounted between the side frame plates;

means for mounting the finishing head on the bar; and adjusting means operatively associated with the bar through at least one of the side frame plates for adjustably moving the bar and thereby, the finishing head longitudinally and axially of the impression cylinder.

* * * * *